US008522646B2

(12) United States Patent
Laird et al.

(10) Patent No.: US 8,522,646 B2
(45) Date of Patent: Sep. 3, 2013

(54) EXPANDABLE EARTH BORING APPARATUS USING IMPREGNATED AND MATRIX MATERIALS FOR ENLARGING A BOREHOLE

(75) Inventors: Tommy Laird, Cypress, TX (US); Navish Makkar, Houston, TX (US)

(73) Assignee: Smith International, Inc., Houston, TX (US)

( * ) Notice: Subject to any disclaimer, the term of this patent is extended or adjusted under 35 U.S.C. 154(b) by 35 days.

(21) Appl. No.: 13/078,041

(22) Filed: Apr. 1, 2011

(65) Prior Publication Data

US 2011/0173896 A1 Jul. 21, 2011

Related U.S. Application Data

(62) Division of application No. 11/870,493, filed on Oct. 11, 2007, now Pat. No. 7,963,348.

(51) Int. Cl.
*B21K 5/04* (2006.01)

(52) U.S. Cl.
USPC ..... 76/108.2; 76/108.4; 175/430; 175/431; 175/435

(58) Field of Classification Search
USPC ..... 76/108.1, 108.2, 108.4; 175/430, 175/431, 435
See application file for complete search history.

(56) References Cited

U.S. PATENT DOCUMENTS

| | | | | |
|---|---|---|---|---|
| 4,140,170 | A * | 2/1979 | Baum | 164/493 |
| 4,398,952 | A * | 8/1983 | Drake | 419/18 |
| 4,667,756 | A * | 5/1987 | King et al. | 175/425 |
| 4,884,477 | A * | 12/1989 | Smith et al. | 76/108.2 |
| 5,373,907 | A * | 12/1994 | Weaver | 175/426 |
| 5,733,664 | A * | 3/1998 | Kelley et al. | 428/457 |
| 6,073,518 | A * | 6/2000 | Chow et al. | 76/108.2 |
| 6,089,123 | A * | 7/2000 | Chow et al. | 76/108.2 |
| 6,732,817 | B2 * | 5/2004 | Dewey et al. | 175/57 |
| 6,742,611 | B1 * | 6/2004 | Illerhaus et al. | 175/433 |
| 7,451,836 | B2 * | 11/2008 | Hoffmaster et al. | 175/263 |
| 7,469,757 | B2 * | 12/2008 | Azar et al. | 175/432 |
| 7,487,849 | B2 * | 2/2009 | Radtke | 175/434 |
| 7,784,381 | B2 * | 8/2010 | Ladi et al. | 76/108.2 |
| 7,963,348 | B2 * | 6/2011 | Laird et al. | 175/263 |
| 2006/0081402 | A1 * | 4/2006 | Lockwood et al. | 175/374 |
| 2009/0031863 | A1 * | 2/2009 | Lyons et al. | 76/108.2 |
| 2010/0108402 | A1 * | 5/2010 | Ponder et al. | 175/428 |
| 2011/0000718 | A1 * | 1/2011 | Bankes et al. | 175/434 |
| 2011/0173896 | A1 * | 7/2011 | Laird et al. | 51/297 |

* cited by examiner

*Primary Examiner* — Hwei C Payer
(74) *Attorney, Agent, or Firm* — Osha Liang LLP

(57) ABSTRACT

A method for forming a borehole enlargement tool that includes providing a steel body structure, forming at least one rib structure from a matrix material and abrasive particles, affixing the at least one rib structure to the body structure, and affixing the steel body structure to an elongated tubular body is disclosed.

4 Claims, 6 Drawing Sheets

EXPANDABLE EARTH BORING APPARATUS USING IMPREGNATED AND MATRIX MATERIALS FOR ENLARGING A BOREHOLE

This patent application is a divisional patent application of U.S. patent application Ser. No. 11/870,493, filed on Oct. 11, 2007, now U.S. Pat. No. 7,963,348.

BACKGROUND OF INVENTION

1. Field of the Invention

Embodiments disclosed herein relate generally to cutting structures used to drill wells in the earth. More specifically, embodiments disclosed herein relate generally to materials used for expandable downhole reaming tools.

2. Background Art

In the drilling of oil and gas wells, typically concentric casing strings are installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation can be reached with comparatively larger diameter casing, thereby providing more flow area for the production of oil and gas.

Various methods have been devised for passing a drilling assembly through a cased borehole, or in conjunction with expandable casing to enlarging the borehole. One such method involves the use of an underreamer, which has basically two operative states—a closed or collapsed state, where the diameter of the tool is sufficiently small to allow the tool to pass through the existing cased borehole, and an open or partly expanded state, where one or more arms with cutters on the ends thereof extend from the body of the tool. In this latter position, the underreamer enlarges the borehole diameter as the tool is rotated and lowered in the borehole.

A "drilling type" underreamer is one that is typically used in conjunction with a conventional "pilot" drill bit positioned below (i.e. downstream of) the underreamer. Typically, the pilot bit drills the borehole to a reduced gauge, while the underreamer, positioned behind the pilot bit, simultaneously enlarges the pilot borehole to full gauge. Formerly, underreamers of this type had hinged arms with roller cone cutters attached thereto. Typical former underreamers included swing out cutter arms that pivoted at an end opposite the cutting end of the cutting arms, with the cutter arms actuated by mechanical or hydraulic forces acting on the arms to extend or retract them. Representative examples of these types of underreamers are found in U.S. Pat. Nos. 3,224,507; 3,425,500 and 4,055,226, all incorporated by reference herein.

Examples of hydraulically expandable, concentric reaming rools are also described in U.S. Pat. Nos. 4,431,065 and 6,732,817. In the '065 patent, a tubular body includes a recess having a cutting arm received therein. The cutting art is moved between a retraced position approximately aligned with the axis of the tubular body and a deployed or activated position extending laterally outwardly of the body by a hydraulic plunger that actuates the cutting arms from a fully retracted to a fully deployed position.

Another device that has been developed is the near-bit reamer. Near-bit reamers may be run into a wellbore with typical steerable BHAs, and the near-bit reamers are generally activated downhole by, for example, hydraulic pressure. When activated, a pressure differential is created between an internal diameter of the reamer and a wellbore annulus. The higher pressure inside the reamer activates pistons that radially displace a reamer cutting structure. The reamer cutting structure is typically symmetrical about a wellbore axis, including, for example, expandable pads that comprise cutting elements. The cutting elements are moved into contact with formations already drilled by the drill bit, and the near-bit reamer expands the diameter of the wellbore by a preselected amount defined by a drill diameter of the expanded reamer outing structure.

While these tools are effective in enlarging/stabilizing a borehole, they are generally considered to be not ideal tools for use when drilling with turbines, for example. Turbines are frequently used in deep wells for longer drilling, as the use of turbines allows for high RPMs* (and greater ROPs) with lower energy and WOB inputs. As the motors or turbines powering the bit improve (higher sustained RPM), and as the drilling conditions become more demanding, the durability of bits and other downhole tools such as reamers also needs to improve. Accordingly, there exists a continuing need for improvements in downhole tools, such as reamers.

SUMMARY OF INVENTION

In one aspect, embodiments disclosed herein relate to a tool for enlarging a borehole that includes an elongated tubular body; at least one movable arm affixed to the tubular body, the at least one movable arm comprising an outer surface formed of at least one of a matrix material and an abrasive material; and at least one actuating member for expanding at least one movable arm from the collapsed state to an expanded state.

In another aspect, embodiments disclosed herein relate to a method of underreaming a wellbore through a formation to form an enlarged borehole that includes using a drill bit to drill the wellbore; disposing an expandable tool having at least one movable arm configured for reaming above the drill bit, the at least one movable arm comprising an outer surface formed of at least one of a matrix material and abrasive particles; expanding the at least one movable arm so that the outer surface of the at least one moveable arm interacts with the formation; and using the at least one movable arm to form the enlarged borehole.

In yet another aspect, embodiments disclosed herein relate to a method of forming a hole enlargement tool that includes providing a steel body structure; forming at least one rib structure from at least one of matrix material and abrasive particles; affixing the at least one rib structure to the body structure; and affixing the steel body structure to an elongated tubular body.

In yet another aspect, embodiments disclosed herein relate to a method of forming a hole enlargement tool that includes loading a mold with a matrix material; heating the contents of the mold to form at least one matrix rib structure affixed to a matrix body; and affixing the body to an elongated tubular body.

Other aspects and advantages of the invention will be apparent from the following description and the appended claims.

DETAILED DESCRIPTION

In one aspect, embodiments disclosed herein relate generally to apparatuses for enlarging a borehole below a restriction and/or for stabilizing a drilling assembly within an enlarged borehole. More specifically, embodiments disclosed herein relate generally to materials used in expandable downhole reaming tools. Even more specifically, embodiments of the present disclosure relate to expandable tools that may alternative between a collapsed position and an expanded or deployed position, where at least one movable arm is affixed to the body of the tool. In a particular embodiment, portions of the moveable arms may be formed from hard particle materials such as metal carbides. Additionally, the hard particle materials may also optionally be impregnated with diamond or other abrasive particles.

It should be appreciated that the materials described with respect to the Figures of some hole enlarging tools that follow may be used in many different drilling assemblies and hole enlarging tools. The following exemplary systems provide only some of the representative tools within which the present invention may be used, but these should not be considered the only tools. In particular, the preferred embodiments of the materials of the present disclosure may be used in any enlargement tool or assembly requiring an expandable underreamer and/or stabilizer for use in controlling the directional tendencies of a drilling assembly in an expanded borehole.

Figure 1:
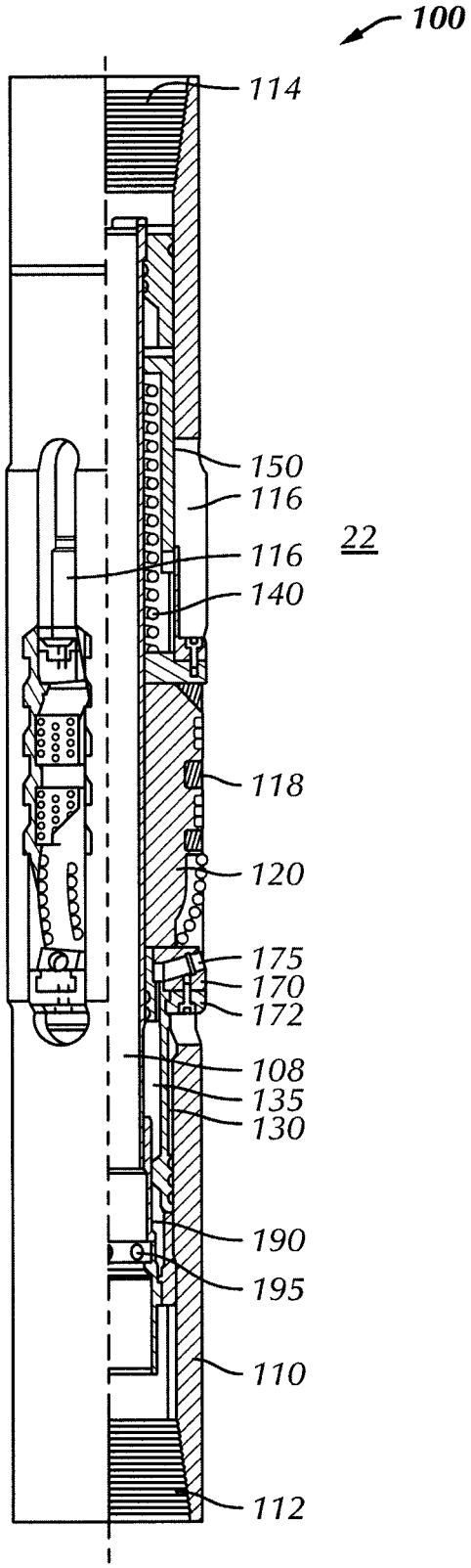
FIG. 1 is a cross-sectional elevation view of one embodiment of the expandable tool of the present disclosure, showing the moveable arms in the collapsed position.
Figure 2:
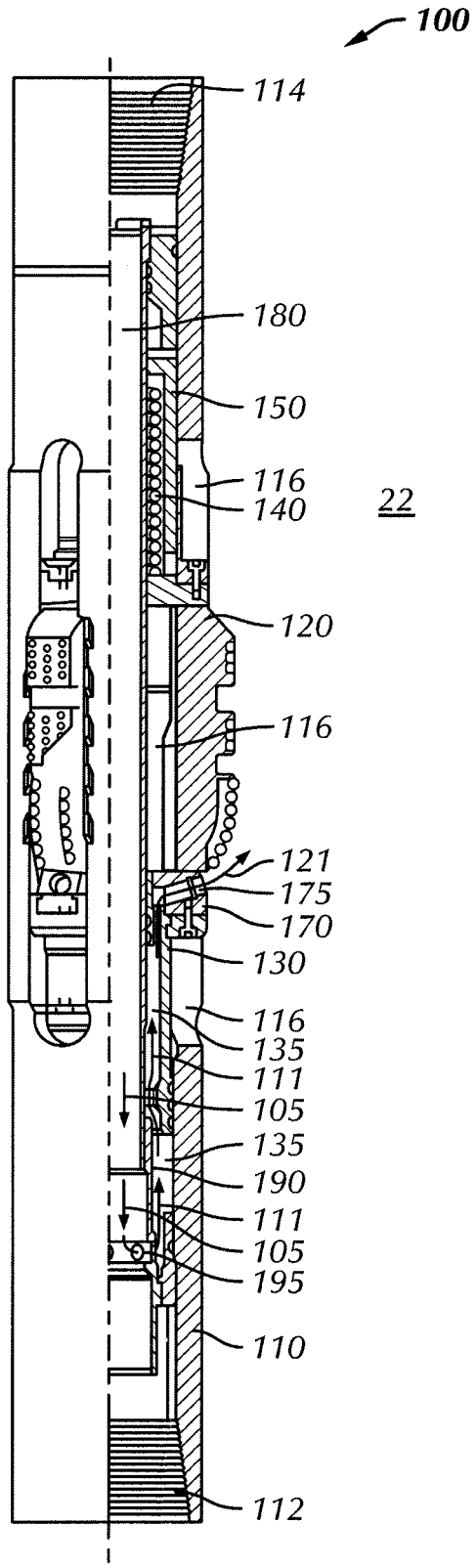
FIG. 2 is a cross-sectional elevation view of one embodiment of the expandable tool of the present disclosure, showing the moveable arms in the expanded position.

Referring now to FIGS. 1 and 2, one embodiment of a type of expandable tool, generally designated as 100, is shown in a collapsed position in FIG. 1 and in an expanded position in FIG. 2. Such type of tool is discussed in greater detail in U.S. Pat. No. 6,732,817, which is assigned to the present assignee and herein incorporated by reference in its entirety; however, a short recitation is given below. The expandable tool 100 comprises a generally cylindrical tool body 110 with a flowbore 108 extending therethrough. The tool body 110 includes upper 114 and lower 112 connection portions for connecting the tool 100 into a drilling assembly. In approximately the axial center of the tool body 110, one or more pocket recesses 116 are formed in the body 110 and spaced apart azimuthally around the circumference of the body 110. The one or more recesses 116 accommodate the axial movement of several components of the tool 100 that move up or down within the pocket recesses 116, including one or more moveable, non-pivotable tool arms 120. Each recess 116 stores one moveable arm 120 in the collapsed position. A preferred embodiment of the expandable tool includes three moveable arms 120 disposed within three pocket recesses 116. In the discussion that follows, the one or more recesses 116 and the one or more arms 120 may be referred to in the plural form, i.e. recesses 116 and arms 120. Nevertheless, it should be appreciated that the scope of the present invention also comprises one recess 116 and one arm 120.

The recesses 116 further include angled channels 118 that provide a drive mechanism for the moveable tool arms 120 to move axially upwardly and radially outwardly into the expanded position of FIG. 2. A biasing spring 140 is preferably included to bias the arms 120 to the collapsed position of FIG. 1. A drive ring block 172 connects a piston 130 to a drive ring 170, wherein the piston 130 is adapted to move axially in the pocket recesses 116 and may be actuated when drilling fluid flows into a piston chamber 135 from flowbore 108. Hydraulic force causes the arms 120 to expand outwardly to the position shown in FIG. 2 due to the differential pressure of the drilling fluid between the flowbore 108 and the annulus 22. Specifically, the drilling fluid flows along path 105, through ports 195 in the lower retainer 190, along path 111 into the piston chamber 135. The differential pressure between the fluid in the flowbore 108 and the fluid in the borehole annulus 22 surrounding tool 100 causes the piston 130 to move axially upwardly from the position shown in FIG. 1 to the position shown in FIG. 2.

As the piston 130 moves axially upwardly in pocket recesses 116, the piston 130 engages the drive ring 170, thereby causing the drive ring 170 to move axially upwardly against the moveable arms 120. The arms 120 will move axially upwardly in pocket recesses 116 and also radially outwardly as the arms 120 travel in channels 118 disposed in the body 110. In the expanded position, the flow continues along paths 105, 111 and out into the annulus 22 along flow path 121 through nozzles 175 for cleaning and cooling of cutting structures disposed on arms 120.

FIG. 2 depicts the tool 100 with the moveable arms 120 in the maximum expanded position, extending radially outwardly from the body 110. Once the tool 100 is in the borehole, it is only expandable to one position. Therefore, the tool 100 has two operational positions—namely a collapsed position as shown in FIG. 1 or an expanded position as shown in FIG. 2. However, a spring retainer 150, can be adjusted at the surface to determine/limit the amount of expansion of arms 120.

Figure 3:
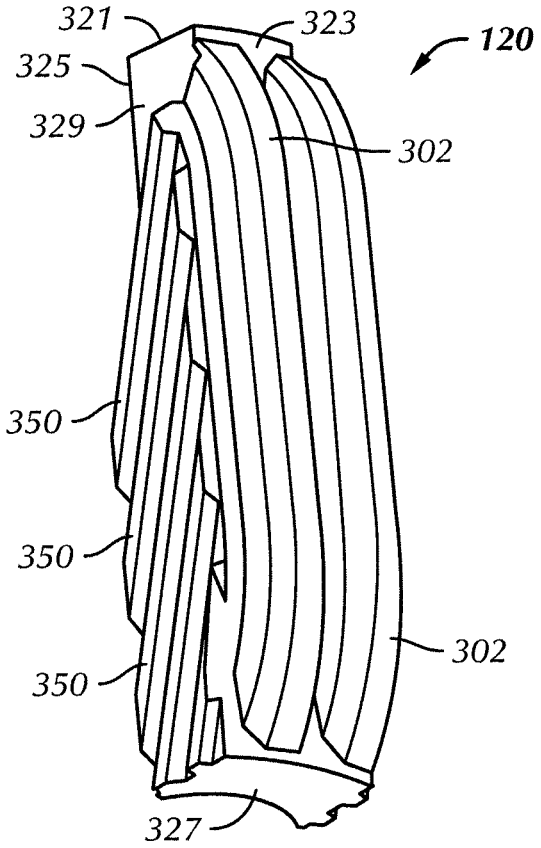
FIG. 3 is a perspective view of a "blank" moveable arm for the expandable tool of FIG. 1.

FIG. 3 provides more detail regarding the moveable arms 120 of FIGS. 1 and 2. FIG. 3 shows a "blank" arm 120 with no cutting structures or stabilizing structures attached thereto. The arm 120 is shown in isometric view to depict a top surface 321, a bottom surface 327, an outer surface 323, a back surface 325, and a side surface 329. The top surface 321 and the bottom surface 327 are preferably angled, as described in more detail below. As shown, arm 120 includes two ribs 302 disposed on the outer surface 323 of the arm 120. The atm 120 also includes extensions or splines 350 disposed along each side 329 of arm 120. The extensions 350 preferably extend upwardly at an angle from the bottom 327 of the atm 120 towards ribs 302. The extensions 350 protrude outwardly from the arm 120 to fit within corresponding channels 118 in the pocket recess 116 of the tool body 110, as shown in FIGS. 1 and 2. The arm 120 depicted in FIG. 3 is a blank version of either movable aim 120 that may provide cutting and/or stabilizing features. Further, ribs 302 may be altered to divide the ribs 302 include multiple sections or to include cutting structures disposed thereon. By changing the structures of or additional features disposed on ribs, the tool 100 may be converted from an underreamer to a stabilizer or vice versa, or to a combination underreamer/stabilizer.

Figure 4A:
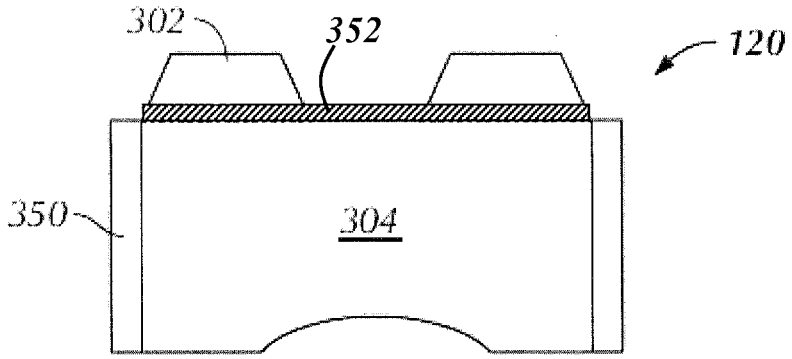
FIGS. 4A-C are cross-sectional views of "blank" moveable arms for the expandable tool of FIG. 1.
Figure 4B:
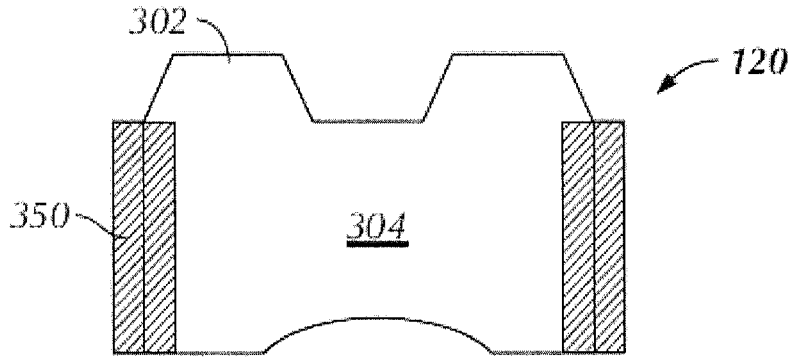
Figure 4C:
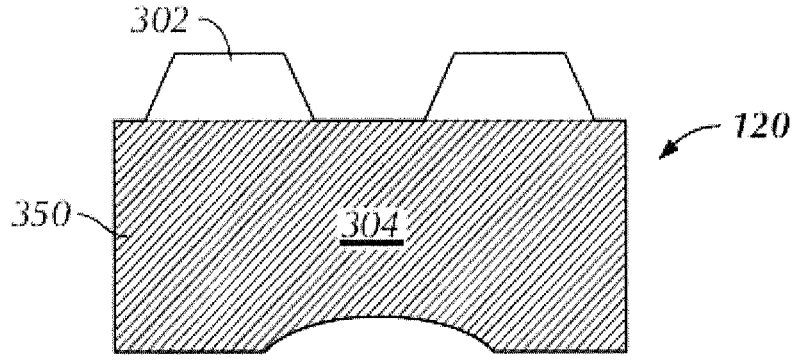

Further, referring to FIGS. 4A-C, cross-sections views of various embodiments of arm 120 are shown. As shown in FIG. 4A, arm 120 includes ribs 302 raised from body 304, which are attached to extensions or splines 350. In accordance with the present disclosure, at least one component of movable arm 120 is formed from hard and/or abrasive materials. For example, ribs 302, and optionally body 304, are formed from a hard particle material such as tungsten carbide. Alternatively, splines 350 may also be formed of such a hard particle material. Further, in yet other embodiments, ribs 302 may be formed from hard matrix materials that are impregnated with abrasive particles such as diamond. One of ordinary skill in the art would appreciate that various combinations of the materials used to form arm 120 may exist. One example is shown in FIG. 4B, where extensions 350 are formed from the conventional reamer material (steel), while body 304 and ribs 302 are formed from a continuous matrix material. However, it is also within the scope of the present disclosure that abrasive materials may be impregnated into at least a portion of the arm 120, such as the ribs 302 (shown in FIG. 6) using impregnation techniques known in the art of impregnated drill bit manufacturing. Matrix-formed portions of arm 120 may be formed as a cutting block which may be affixed to steel plates 352 (shown in FIG. 4A) or other components of tool 100 by infusing the pieces together in the mold, by brazing the pieces together, or by other techniques known in the art. Referring to FIG. 4C, another example of arm 120 is shown. As shown in FIG. 4C, body 304 is formed of a conventional steel material, and ribs 302 are affixed thereto. Ribs 302 may be formed of a hard matrix material with optional abrasive particles impregnated therein. To form such an arm 120, matrix and/or impregnated ribs 302 may be affixed to a steel block, such as by brazing. However, one of skill in the art would appreciate that a variety of techniques such as casting, brazing, and infusing may be used.

Matrix materials that may be used to form at least one component of movable arms of the present disclosure may include hard particles, such as tungsten carbide, and a binder. Exemplary types of tungsten carbide include macrocrystalline tungsten carbide particles, carburized tungsten carbide particles, cast tungsten carbide particles, and sintered tungsten carbide particles. In other embodiments, non-tungsten carbides, oxides, or nitrides of vanadium, chromium, titanium, tantalum, niobium, and other carbides of the transition metal group may be used. A binder may also optionally include a binder powder that may, for example, include cobalt, nickel, iron, chromium, copper, molybdenum and other transition elements and their alloys, and combinations thereof, an infiltrating binder, that may include at least one of nickel, copper, and alloys thereof, and a Cu—Mn—Ni—Zn alloy in a preferred embodiment, and/or an optional non-metallic binder such as organic wax or polyethylene glycol (PEG).

Further, the ribs and body may be formed using traditional techniques known in the art. The arm components of the present disclosure may be prepared by a number of different methods, e.g., by infiltration, casting, or other sintering techniques, including layered manufacturing. Further, one of ordinary skill in the art would appreciate that other methods may be used, such as, for example, solid state or liquid phase sintering, pneumatic isostatic forging, spark plasma sintering, microwave sintering, gas phase sintering, and hot isostatic pressing.

Infiltration processes that may be used to form a rib and/or body structure of the present disclosure may begin with the fabrication of a mold, having the desired body shape and component configuration. A mass of carbide particles and, optionally, metal binder powder may be infiltrated with a molten infiltration binder. Alternatively, casting processes may be used, in which a molten mixture of carbide particles and a binder may be either poured into a mold, or melted within a mold, and then cooled to cast the composite body. Further, layered manufacturing of a composite body involves the sintering of a first layer of particles together by a layered manufacturing equipment, after which a second layer of particles is disposed over the first layer and sintered in selected regions of the second layer together and to the first layer. The process repeats to fabricate subsequent layers until the desired part has been formed from the composite material particles. Once the rib and/or body of the moveable arm has been fabricated from the composite body material, the particulate-based part may be infiltrated with a binder material that binds adjacent particles of matrix material together, and forms a substantially integral part that represents the model used to generate the article.

Thus, in a particular embodiment, a tungsten carbide matrix is used form at least one of the rib and body of the movable arms of the present disclosure. Tungsten carbide is a chemical compound containing both the transition metal tungsten and carbon. This material is known in the art to have extremely high hardness, high compressive strength and high wear resistance which makes it ideal for use in high stress applications. Its extreme hardness makes it useful in the manufacture of cutting tools, abrasives and bearings, as a cheaper and more heat-resistant alternative to diamond.

Sintered tungsten carbide, also known as cemented tungsten carbide, refers to a material formed by mixing particles of tungsten carbide, typically monotungsten carbide, and particles of cobalt or other iron group metal, and sintering the mixture. In a typical process for making sintered tungsten carbide, small tungsten carbide particles, e.g., 1-15 micrometers, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or pellets such as by pressing through a screen, or tumbling and then screened to obtain more or less uniform pellet size.

Such green compacts or pellets are then heated in a vacuum furnace to first evaporate the wax and then to a temperature near the melting point of cobalt (or the like) to cause the tungsten carbide particles to be bonded together by the metallic phase. After sintering, the compacts are crushed and screened for the desired particle size. Similarly, the sintered pellets, which tend to bond together during sintering, are crushed to break them apart. These are also screened to obtain a desired particle size. The crushed sintered carbide is generally more angular than the pellets, which tend to be rounded.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide.

Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

Another type of tungsten carbide is macro-crystalline tungsten carbide. This material is essentially stoichiometric WC. Most of the macro-crystalline tungsten carbide is in the form of single crystals, but some bicrystals of WC may also form in larger particles. Single crystal monotungsten carbide is commercially available from Kennametal, Inc., Fallon, Nev.

Carburized carbide is yet another type of tungsten carbide. Carburized tungsten carbide is a product of the solid-state diffusion of carbon into tungsten metal at high temperatures in a protective atmosphere. Sometimes it is referred to as fully carburized tungsten carbide. Such carburized tungsten carbide grains usually are multi-crystalline, i.e., they are composed of WC agglomerates. The agglomerates form grains that are larger than the individual WC crystals. These large grains make it possible for a metal infiltrant or an infiltration binder to infiltrate a powder of such large grains. On the other hand, fine grain powders, e.g., grains less than 5 do not infiltrate satisfactorily. Typical carburized tungsten carbide contains a minimum of 99.8% by weight of WC, with total carbon content in the range of about 6.08% to about 6.18% by weight.

Abrasive particles that may be impregnated in the matrix material may be selected from synthetic diamond, natural diamond, reclaimed natural or synthetic diamond grit, silicon carbide, aluminum oxide, tool steel, boron carbide, cubic boron nitride (CBN), thermally stable polycrystalline diamond (TSP), or combinations thereof, which may all be uncoated or coated such as with a CVD or PVD retention coating. In a particular embodiment, an impregnated rib may be formed from the infiltration of encapsulated abrasive particles, such as described in U.S. patent application Ser. No. 11/779,104, which is assigned to the present assignee and herein incorporated by reference in its entirety. In such an embodiment, the materials that make up the encapsulated abrasive particles and infiltrating matrix material may be tailored to achieve desired properties such as abrasion resistance, diamond exposure, toughness, etc, to achieve a more durable movable arm.

Further, while not shown in FIG. 3 or 4A-C, various types of cutting elements may also be affixed to the ribs 302 for cutting (underreaming or back reaming). Among the types of cutting elements that may be affixed to ribs 302 include polycrystalline diamond compacts (PDCs), tungsten carbide inserts, polycrystalline cubic boron nitride (PCBN) cutting elements, diamond impregnated inserts, such as those described in U.S. Pat. No. 6,394,202 and U.S. Patent Publication No. 2006/0081402, which are assigned to the present assignee and herein incorporated by reference in their entirety, and various shearing elements that may be formed from polycrystalline diamond, PCBN, thermally stable polycrystalline diamond (TSP). For example, shearing elements or discs comprising PCD or TSP may be affixed to a diamond impregnated rib, similar to the cutting structures described in U.S. Patent Publication Nos. 2005/0133278 and 2006/0032677, which are both assigned to the present assignee and herein incorporated by reference in their entirety. Further, it is also within the scope of the present disclosure that diamond impregnated surfaces, such as ribs, may be sand blasted for controlled diamond exposure.

Figure 5:
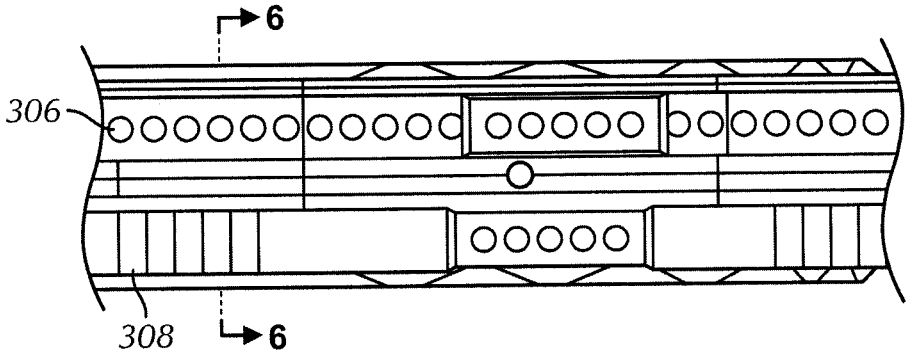
FIG. 5 is a top view of one embodiment of a moveable arm.
Figure 6:
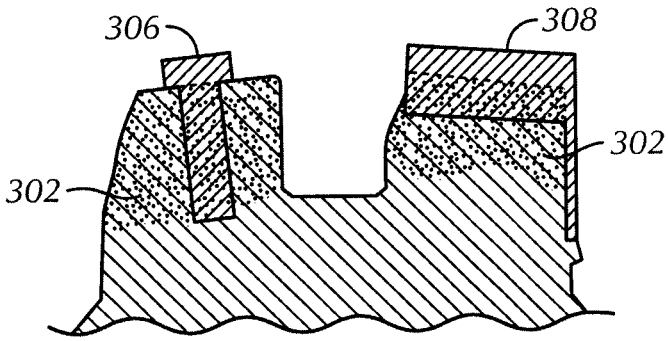
FIG. 6 is a cross-sectional view of the moveable arm shown in FIG. 5.

In a particular embodiment, diamond impregnated inserts, such as those described in U.S. Pat. No. 6,394,202 and U.S. Patent Publication No. 2006/0081402, frequently referred to in the art as grit hot pressed inserts (GHIs), may be mounted in sockets formed in a rib substantially perpendicular to the surface of the rib and affixed by brazing, adhesive, mechanical means such as interference fit, or the like, similar to use of GHIs in diamond impregnated bits, as discussed in U.S. Pat. No. 6,394,202. Alternatively, sockets may be inclined with respect to the surface of the rib so that insert are oriented substantially in the direction of the rotation of the reamer, so as to enhance cutting. In yet another alternative embodiment, such inserts may be stacked within a rib 302, along its length, in a side by side fashion. As shown in FIGS. 5 and 6, one diamond impregnated rib 302 includes substantially perpendicular inserts 306, while the other diamond impregnated rib 302 includes inserts 308 laid side by side. As shown, diamond impregnation is most heavily localized in the outer surface region of rib 302. Further, one of ordinary skill in the art would appreciate that any combination of the above discussed cutting elements may be affixed to any of the ribs of the present disclosure.

Further, one of ordinary skill in the art would appreciate that wear pad(s) with wear buttons, such as those described in U.S. Pat. No. 6,732,817 may be used in conjunction with any of the above ribs which may be used to provide a stabilizing and gauge protection function.

Additionally, while the above discussion of movable arms (and extension thereof), and specifically, the materials from which they may be formed, are made with respect to those types described in FIGS. 1 and 2 (and U.S. Pat. No. 6,732,817, the present disclosure is not so limited. Rather, the use of matrix and/or impregnated materials on components of movable arms may be extended to any type of movable arm known in the art, which includes arms that are pivotedly extended, extended as a result of an axial and/or radial actuation, etc. However, no limitation on the type of action that results in extension of movable arms is intended by the present application.

Figure 7:
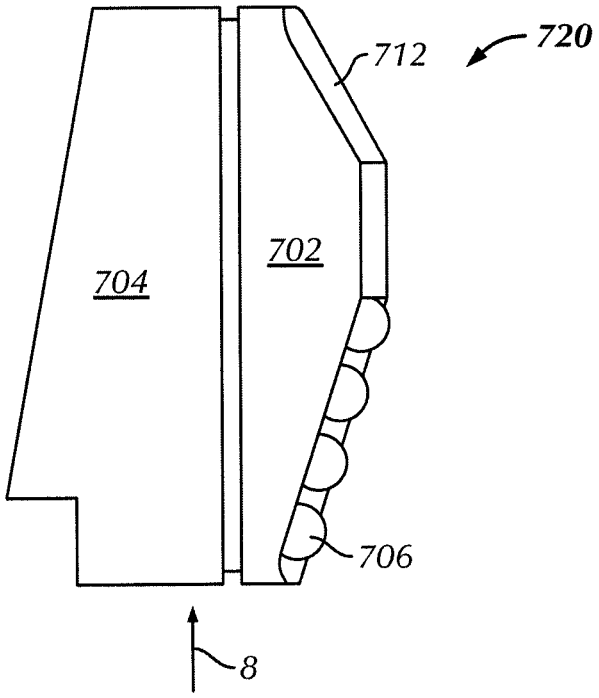
FIG. 7 is a perspective view of one embodiment of a moveable arm.
Figure 8:
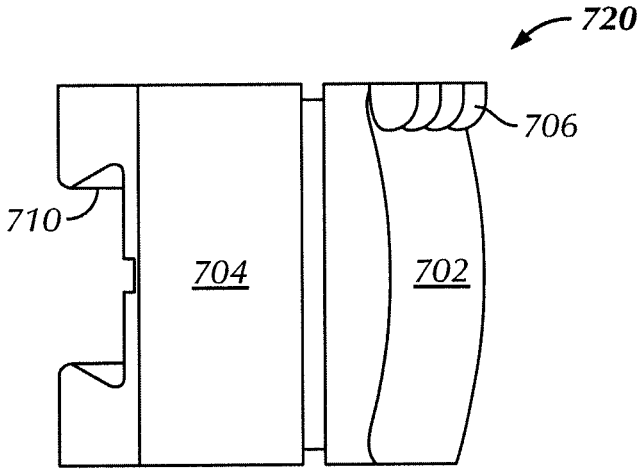
FIG. 8 is a bottom view of the moveable arm shown in FIG. 7.

For example, as discussed in U.S. Pat. No. 6,615,933, which is herein incorporated by reference in its entirety, movable or extendable arms (members or cutters as described in U.S. Pat. No. 6,615,933) mounted within ports or recesses within a tubular body are actuated by a combination of applied weight on bit through axial movement of a cam sleeve engaged with the extendable arms to induce radial extension of those extendable members and/or hydraulic pressure to life the main body. Referring to FIGS. 7 and 8, another embodiment of a movable or extendable arm, which may find use in various expandable tools, including that described in U.S. Pat. No. 6,615,933, is shown. As shown in FIGS. 7 and 8, moveable arm 720 includes body 704 that engages with cam (not shown) at 710. Rib 702 is affixed to body 704. On the leading edge of rib 702, cutting elements 706 such as PDC cutters or shearing elements, as discussed above, may be attached. Further, while only the lower leading edge of rib 702 is shown as including cutting elements, one of ordinary skill in the art would appreciate that they may optionally be placed on the upper leading edge of rib 702. Further, as discussed above, at least one component of arm 702 is formed from a matrix material and/or impregnated matrix material. In a particular embodiment, rib 702 may, for example, be formed of tungsten carbide, with diamond impregnation localized in the outer surface region of rib 702. Further, while arm 720 is shown as only including a single rib 702, one of ordinary skill in the art would appreciate that the structure may be divided axially into two (or more) ribs. Further, the use of the term rib may refer to any tapered, spiral, or substantially straight, longitudinally extending sections on an arm extending outwardly from a tubular body Other examples of types of movable or extendable arms include those such as described in U.S. Pat. Nos. 6,378,632 (which move by sliding outward as a result of hydraulic actuation), 4,431,065 (which pivot or swing outwardly as a result of hydraulic actuation), 6,668,949 (which pivot outwardly as a result of hydraulic actuation), 7,036,611 (which moves radially outward by hydraulic actuation), 4,461,361 (which pivot outwardly as a result of hydraulic actuation), all of which are herein incorporated by reference in their entirety. Thus, any of the above moveable arms (or components of the arms) may be formed from a hard matrix material and/or a diamond impregnated matrix material. Further, in a particular embodiment, the rib or blade portions of the arms, which may have a variety of cutting elements disposed thereon, may in particular be formed from a diamond impregnated matrix material, while a supporting body portion of the arm may be formed from steel or a matrix material. Extension of the arms may be result from hydraulic or mechanical actuation.

Further, in a particular embodiment, the tools of the present disclosure are used with turbine type motor because turbine motors operate at higher rotary speeds and consequently can operate at lower weight on bit than do positive displacement motors in order to achieve a comparable rate of penetration. However, the present disclosure is not necessarily limited as such. Rather, it is specifically within the scope of the present disclosure that the reamers may be used with other systems.

Advantageously, embodiments of the present disclosure for at least one of the following. By providing reamer arms formed from hard and/or abrasive particles, the arms may possess greater resistance to wear and erosion, as compared to a traditional (optionally hardfaced) steel material. Greater wear and erosion resistance may allow for the expandable reamers to be used for longer drilling hours, in more abrasive formations and/or at high RPMs which results in large amounts of wear to downhole tools. Further, by providing a more wear and abrasion resistant structure, enlarging a borehole and maintaining gage may be better achieved. Additionally, by using such types of materials, self-sharpening cutting structures may be obtained.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method of forming a hole enlargement tool, comprising:

forming an elongated tubular body having at least one recess to receive at least one movable arm body;

forming the at least one movable arm body to conform to the recess in the elongated tubular body;

loading a mold with a matrix material;

heating the contents of the mold to form at least one matrix rib structure;

brazing or infusing steel plates to the at least one matrix rib structure;

affixing the steel plates to the at least one movable arm body; and disposing the at least one movable arm body in the recess within the elongated body.

2. The method of claim 1, further comprising:

loading the mold with abrasive particles to form the abrasive particles impregnated in the at least one matrix rib structure.

3. The method of claim 1, wherein forming the movable arm body comprises making the movable arm body from a tungsten carbide matrix material and abrasive particles impregnated in the tungsten carbide matrix material.

4. The method of claim 1, further comprising adding at least one actuating member for expanding the at least one movable arm from a collapsed state to an expanded state.

* * * * *